US005095182A

United States Patent [19]

Thompson

[11] Patent Number: 5,095,182

[45] Date of Patent: Mar. 10, 1992

[54] SHOCKPROOF SAFETY OUTLET

[76] Inventor: Carl M. Thompson, 38 Stewart St., Bayshore, N.Y. 11706-2722

[21] Appl. No.: 636,112

[22] Filed: Dec. 31, 1990

[51] Int. Cl.[5] ..... H01R 33/96; H01H 27/00

[52] U.S. Cl. ..... 200/51.09; 200/43.04; 200/43.05

[58] Field of Search ..... 200/51.09, 43.05, 43.07, 200/43.09, 243, 245, 293, 299, 51.01, 51.11, 296, 296

[56] References Cited

U.S. PATENT DOCUMENTS

| | | | |
|---|---|---|---|
| 3,159,725 | 12/1974 | Dennis | 200/51.09 |
| 4,393,283 | 7/1983 | Masuda | 200/51.09 |
| 4,853,823 | 8/1989 | Arechavaleta et al. | 200/51.09 X |
| 4,858,438 | 12/1989 | Tajima | 200/51.09 |

FOREIGN PATENT DOCUMENTS 2330401 11/1974 Fed. Rep. of Germany ... 200/51.09

*Primary Examiner*—Henry J. Recla
*Assistant Examiner*—David J. Walczak
*Attorney, Agent, or Firm*—Richard L. Miller

[57] ABSTRACT

A shockproof safety outlet is provided and consists of a plug receptacle having typically a least a large neutral blade-slot and a small hot line blade-slot for receiving a large neutral blade and a small hot line blade of a corresponding and mating multiprong plug. Provision for removably mounting a normally opened switch assembly to be electrically connecting into the hot line with a non-conductive actuating button in alignment behind the blade-slot in the plug receptacle. When a blade of the plug is inserted into a blade-slot it will depress the actuating button and close the switch assembly thereby activating the plug receptacle to supply current to the plug.

2 Claims, 1 Drawing Sheet

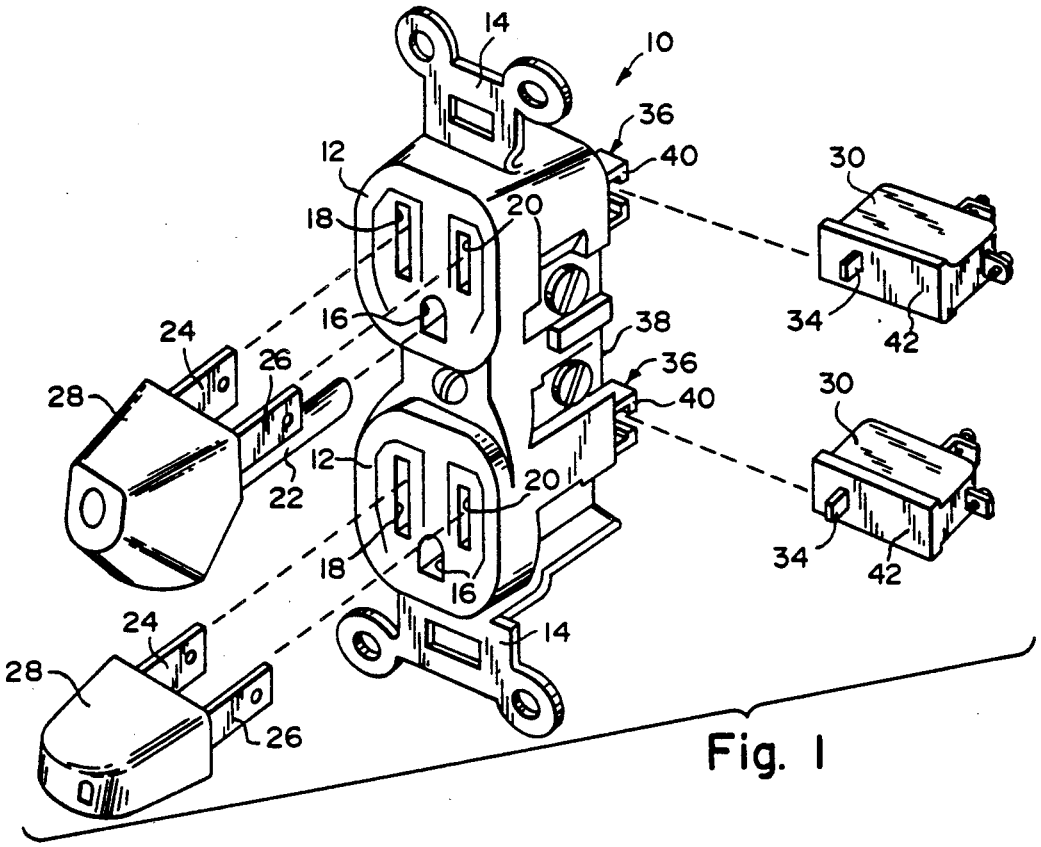
Fig. 1
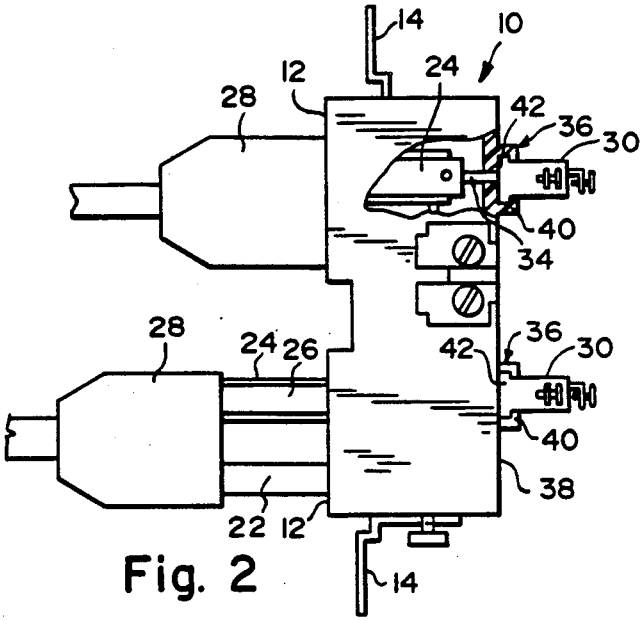
Fig. 2
Fig. 3
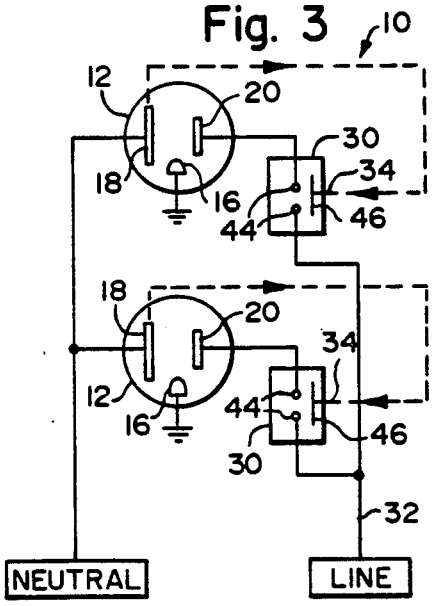

SHOCKPROOF SAFETY OUTLET

BACKGROUND OF THE INVENTION

The instant invention relates generally to electrical outlets and more specifically it relates to a shockproof safety outlet.

Numerous electrical outlets have been provided in the prior art that are adapted to include built in structures which will prevent accidental shocks from the outlets. For example, U.S. Pat. Nos. 3,699,285 to Leatherman; 3,846,598 to Muesi and 4,271,337 to Barkas all are illustrative of such prior art. While these units may be suitable for the particular purpose to which they address, they would not be as suitable for the purpose of the present invention as hereafter described.

SUMMARY OF THE INVENTION

A primary object of the present invention is to provide a shockproof safety outlet that will overcome the shortcomings of the prior art devices.

Another object is to provide a shockproof safety outlet in which the neutral blade of a plug will close a normally switch assembly that is electrically connected to the hot line to activate the circuit to the outlet.

An additional object is to provide a shockproof safety outlet in which the switch assembly is disengagable from the back of the outlet for repair and replacement when needed.

A further object is to provide a shockproof safety outlet that is simple and easy to use.

A still further object is to provide a shockproof safety outlet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention with parts exploded therefrom;

FIG. 2 is a diagrammatic side view with parts broken away; and

FIG. 3 is an electrical schematic of the instant invention.

DETAILED DESCRIPTION OF THE PREFERRED EMBODIMENTS

Turning now descriptively to the drawings, in which like reference characters denote like elements throughout the several views, the Figures illustrate a shockproof safety outlet 10 which is typically a three blade-slot electrical grounding outlet having two plug receptacle portions 12 and mounting brackets 14. Since the receptacle portions 12 of the outlet are duplicate, the preferred embodiment of the invention will be described hereinafter with respect to a single receptacle unit. The plug receptacle 12 has typically, but not necessarily, a ground prong blade-slot 16, a large, neutral blade-slot 18 and a small, hot line blade-slot 20 for receiving a mating plug with or without a ground prong 22, a large neutral blade 24 and a small, hot line blade 26 of a corresponding and mating multiprong grounding plug 28. A normally open switch assembly 30 is selectively connected into the hot line 32 and has a non-conductive actuating button 34 in alignment behind, typically, the large, neutral blade-slot 18 in the plug receptacle 12. When the large, neutral blade 24 of the plug 28 is inserted into the large, neutral blade-slot 18 it will depress the actuating button 34 and close the switch assembly 30 thereby activating the plug receptacle 12 to supply current to the plug 28.

Means 36 are provided for slideably mounting the switch assembly 30 on the back wall of the plug receptacle 12 so that the actuating button 34 will be in alignment behind the large blade-slot 18. The switch assembly 30 can be disengaged from the plug receptacle 12 for repair and replacement when needed. If, in a particular application, it is desired not to have this safety feature implemented, then the plug receptacle 12 may be wired in the ordinary fashion with the switch assembly 30 omitted. The slideably mounting means 36 includes a horizontal track 40 formed on the back wall 38 of the plug receptacle. Guide member 42 is formed on the front of the switch assembly 30 to slide within the track 40 until the actuating button 34 is in alignment behind the large neutral blade-slot 18 of the plug receptacle 12. The switch assembly 30 is a pushbutton type having typically a pair of fixed contacts 44 electrically connected to the hot line 32 and a moving contact arm 46 physically connected to the actuating button 34. When the large, neutral blade 24 of the plug 28 depresses the actuating button 34, the moving contact arm 46 will engage with the fixed contacts 44 to close the hot line 32. It is to be understood that the schematic illustration of the switch in FIG. 3 is typical only and that there are many other ways of arranging switch internal components such as blades, contacts, springs and toggling mechanism which will function quite well, are well known to those involved in the art of designing switches, and are beyond the scope of this disclosure.

It is to be noted that, although in the illustrations it is shown that the large neutral blade 24 is used to depress the switch button 34, it is only matter of design choice and any blade of the mating plug 28 might be chosen.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shockproof outlet comprising:

a) a plug receptacle of the type having a front mating face and a back wall and having a neutral blade-slot and a hot line blade-slot opening to said front, mating face thereof and receiving, in a mating direction, a neutral blade and a hot line blade, respectively, of a corresponding, mating plug; and b) a normally opened switch assembly of the pushbutton type, to be electrically connected into a hot line and having a non-conductive actuating button for alignment behind a selected blade-slot in said plug receptacle so that when a mating multiprong plug is inserted into the plug receptacle, a blade of the plug entering the blade-slot will depress the actuating button and close the said switch assembly thereby activating said plug receptacle to supply current into the plug; and mounting means including:

i) a track extending transversely of the mating direction formed on the back wall of said plug receptacle; and ii) a mating guide member formed on the front of said switch assembly for sliding receipt in said track until the actuating button is brought into alignment behind the selected blade-slot of said plug receptacle, so that said switch assembly can be disengaged from said plug receptacle for repair and replacement when needed.

2. A shockproof outlet comprising:

a) a plug receptacle of the type having a front mating face and a back wall and having a neutral blade-slot, a hot line blade-slot and a ground blade-slot opening to said front, mating face thereof and receiving, in a mating direction, a neutral blade, a hot line blade and a ground blade, respectively of a corresponding, mating plug; and b) a normally opened switch assembly of the push-button type, to be electrically connected into a hot line and having a non-conductive actuating button for alignment behind a selected blade-slot in said plug receptacle so that when a mating multiprong plug is inserted into the plug receptacle, a blade of the plug entering the blade-slot will depress the actuating button and close the said switch assembly thereby activating said plug receptacle to supply current into the plug; and mounting means including:

i) a track extending transversely of the mating direction formed on the back wall of said plug receptacle; and ii) a mating guide member formed on the front of said switch assembly for sliding receipt in said track until the actuating button is brought into alignment behind the selected blade-slot of said plug receptacle, so that said switch assembly can be disengaged from said plug receptacle for repair and replacement when needed.

* * * * *